US005879251A

United States Patent [19]

Rose

[11] Patent Number: 5,879,251

[45] Date of Patent: Mar. 9, 1999

[54] DOUBLE BALL DEVICE

[76] Inventor: Matthew N. Rose, P.O. Box 2293, Danbury, Conn. 06813

[21] Appl. No.: 944,077

[22] Filed: Oct. 4, 1997

[51] Int. Cl.[6] ..... A63B 37/12

[52] U.S. Cl. ..... 473/576; 473/600

[58] Field of Search ..... 473/574, 575, 473/576, 596, 600, 601, 602, 614, 615, 423, 424, 425, 426, 427, 428, 429, 430; 463/47.5

[56] References Cited

U.S. PATENT DOCUMENTS

| | | | |
|---|---|---|---|
| 612,173 | 10/1898 | Newton | 473/576 |
| 2,408,160 | 9/1946 | Brunner | 473/575 |
| 4,042,241 | 8/1977 | Collins | 473/424 |
| 4,593,901 | 6/1986 | Moore et al. | 473/575 |
| 4,696,472 | 9/1987 | Meyer | 473/575 |
| 4,826,179 | 5/1989 | Callaghan | 473/576 |

OTHER PUBLICATIONS

Gordon C. Baldwin, Games of the American Indian, 1969, pp. 118–119.

Allan MacFarlan, Book of American Indian Games, 1958, pp. 180–181.

*Primary Examiner*—Steven Wong

[57] ABSTRACT

A multi-piece double ball construction is described in which there is: a first piece of durable material having an essentially linear shape along its middle section and terminating at a first end in a first essentially hourglass shaped section and at a second end in a second essentially hourglass shaped section; a second piece of durable material having an essentially hourglass shape essentially similar in size to the hourglass shape of the first hourglass shaped section; a third piece of durable material having an essentially hourglass shape essentially similar in size to the hourglass shape of the second hourglass shaped section; a first deformable core positioned between the second piece of durable hourglass shaped material and the first hourglass shaped section of the first piece; a second deformable core positioned between the third piece of durable hourglass shaped and the second hourglass shaped section of the first piece; first stitching for securing the second piece of durable hourglass shaped material to the first hourglass shaped section of the first piece around the first deformable core so as to form a first spherical shape at the first end of the first piece of durable material; and second stitching for securing the third piece of durable hourglass shaped material to the second hourglass shaped section of the first piece around the second deformable core so as to form a spherical shape at the second end of the first piece of durable material; wherein the middle section of the first piece hold the first and second spherical shapes together so as to allow the first and second spherical shapes to move together when thrown by a player during play.

15 Claims, 4 Drawing Sheets

DOUBLE BALL DEVICE

BACKGROUND OF THE INVENTION

This invention is directed generally to a double ball device and more particularly to a double ball device of a unique construction.

The game of double ball is an old Indian game. Originally a game appealing to Indian women, the game is played with two balls and a tossing stick. A cord tied between the two balls keeps the balls together when the balls are moved. Placement of the tossing stick underneath the cord allows the balls to be picked up and moved.

The game is typically played on a field. The Pima Indian women are known to have played this game on a smooth 400 yard stretch of terrain. A pair of spaced apart goal posts is located on either end of the field for scoring. Each player is provided a stick. The object of the game was to move the double ball downfield toward the other team's goalpost using a stick. A player scored by placing the double ball over a crossbar that hung between goal posts using the stick.

Sticks used to play double ball are known to have varied in size and shape. The Pima Indian women of Arizona were known to have used willow or alder tossing sticks. Typically, the sticks varied from 2 to 6 feet. Often sticks about 45 inches in length were known to have been used. On one end, the sticks were shaped to form a handle. On the other end, the sticks were typically thinner in construction and slightly curved so as to make it easier to pick up the ball by the cord.

Several materials were used to make the balls. Buckskin fastened together with a rawhide cord a toot or so long served as a good double ball for some groups. Some tribes stuffed hair inside a buckskin pouch forming the ball. The Sauk and Foxes and other Algonkian tribes often weighted their balls with sand. The Chippewa, Papago, Hupa, and Klamath Indians made their balls out of short cylinders of wood, or bone, and tied the balls together with a rawhide cord. Others played with two wooden billets. Still others used blocks of wood.

The cord holding the balls together were typically a rawhide cord a foot or so long. A special construction was used by the Pima women who were known to have knotted two balls to a stout leather thong. One known thong was constructed from a 6-inch, 4- strand, 2-ply leather. The cords or thongs could be attached to each ball in a number of ways. As shown in FIG. 1, two openings 22, 23 on one ball 20 could allow one end of cord 30 to be threaded through the opening, run along the inside of the ball and out of a second opening. The free end of the cord can be tied to the part of the cord extending between the balls so as to form a knot 32. The other ball 20' is attached in the same way.

Where attachment of the cord to the balls is by a knot formed in the connecting cord at each ball each knot is found to create a point that interferes with the free movement of each ball with respect to the cord connecting the two balls. This point of interference makes it more difficult to throw the double ball accurately. In addition, the ball needs to be modified to allow the cord to be attached to the ball. This is found to weaken the point of connection of the ball to the cord. Excessive wear and tear resulting from friction between the knot, the ball and the cord can lead to premature breaks in the cord, resulting in a delay of game.

In some constructions, the cord and the ball were made from a single piece of material. Maricopa Indians were know to have used strips of leather or willow bark about 9 inches long, with a heavy knot at either end. In a double ball constructed from a single piece of material, there is no point of connection between the cord and the balls which create the foregoing type of interference with ball movement. The tradeoff, however, is an interference of another kind resulting from the single piece of material constraining the movement that can be taken between the connection and the balls. With reduced degree of motion permitted the balls by a one piece construction, some of the fun in the game is found to be taken away. In addition, forming balls by knotting the ends of a single piece of material does not give the balls much weight. As a result, the balls move with less momentum, farther detracting from the fun of the game.

SUMMARY

It is are object of this invention to provide a double ball device that is of a more durable construction than prior known double ball devices.

It is another object to provide a double ball device having a multi-piece construction that is so interconnected as between the pieces as to form a more integral fit.

Yet another object is to provide such a multi-piece double ball construction that has its pieces interconnected in a way that is more durable than the ways multi-piece balls are known to be connected.

Still another object is to provide such a multi-piece double ball construction that while durable at the points of connection between the several piece making up the double ball, allows for good freedom of movement of the balls with respect to the connecting piece, leading to more fun when the ball is in play.

Yet a further object is that such a durable multi-piece construction ball allows for greater weighting of the balls without over-stressing the points of connection between the balls and the piece connecting the two balls; thereby reducing the incidents of failure of the piece connecting the balls, and the number of replacements required to be made of the double ball during a game.

To meet these and other objects, I have devised a device for use in playing double ball comprising: a first piece of durable material having an essentially linear shape along its middle section and terminating at a first end in a first essentially hourglass shaped section and at a second end in a second essentially hourglass shaped section; a second piece of durable material having an essentially hourglass shape essentially similar in size to the hourglass shape of said first hourglass shaped section; a third piece of durable material having an essentially hourglass shape essentially similar in size to the hourglass shape of said second hourglass shaped section; a first deformable core positioned between said second piece of durable hourglass shaped material and said first hourglass shaped section of said first piece; a second deformable core positioned between said third piece of durable hourglass shaped and said second hourglass shaped section of said first piece; first means for securing said second piece of durable hourglass shaped material to said first hourglass shaped section of said first piece around said first deformable core so as to form a first spherical shape at said first end of said first piece of durable material; and second means for securing said third piece of durable hourglass shaped material to said second hourglass shaped section of said first piece around said second deformable core so as to form a spherical shape at said second end of said first piece of durable material; wherein said middle section of said first piece holds said first and second spherical shapes together so as to allow said first and second spherical shapes to move together when thrown by a player during play.

DETAILED DESCRIPTION OF THE INVENTION

Figure 1:
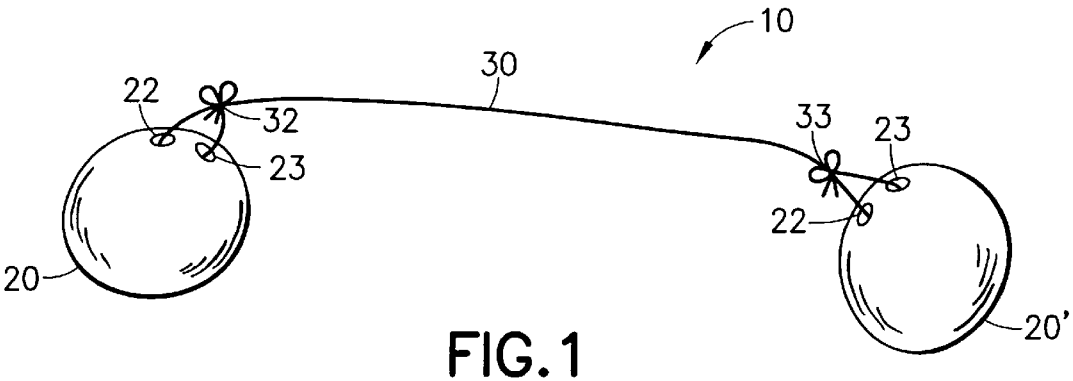
FIG. 1 PRIOR ART
FIG. 1 shows a prior art double ball device.
Figure 2:
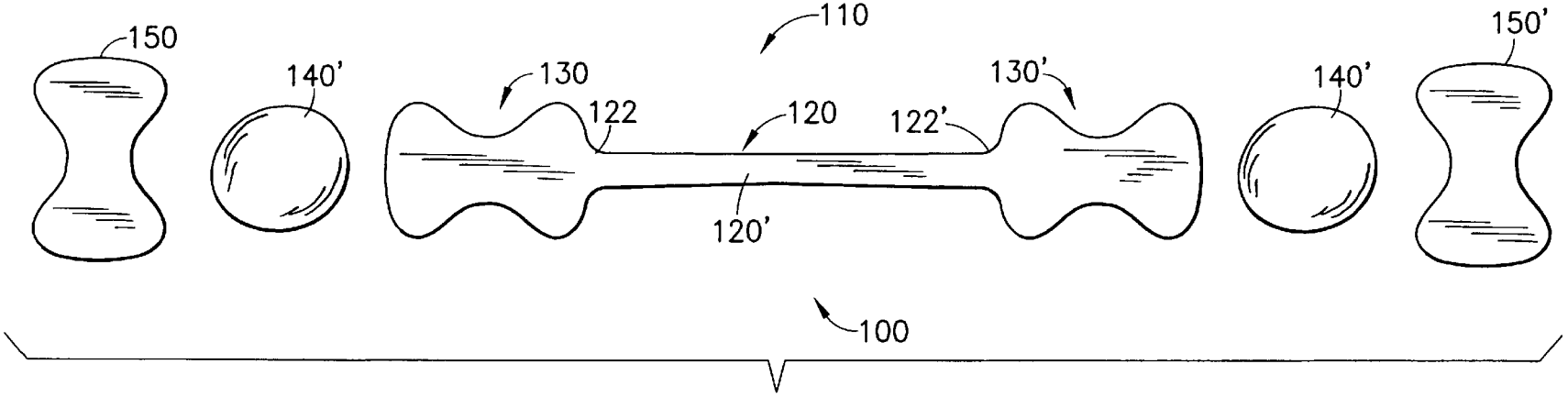
FIG. 2 shows in exaggerated fashion the individual pieces of a double ball device constructed in accordance with this invention.
Figures 3, 4:
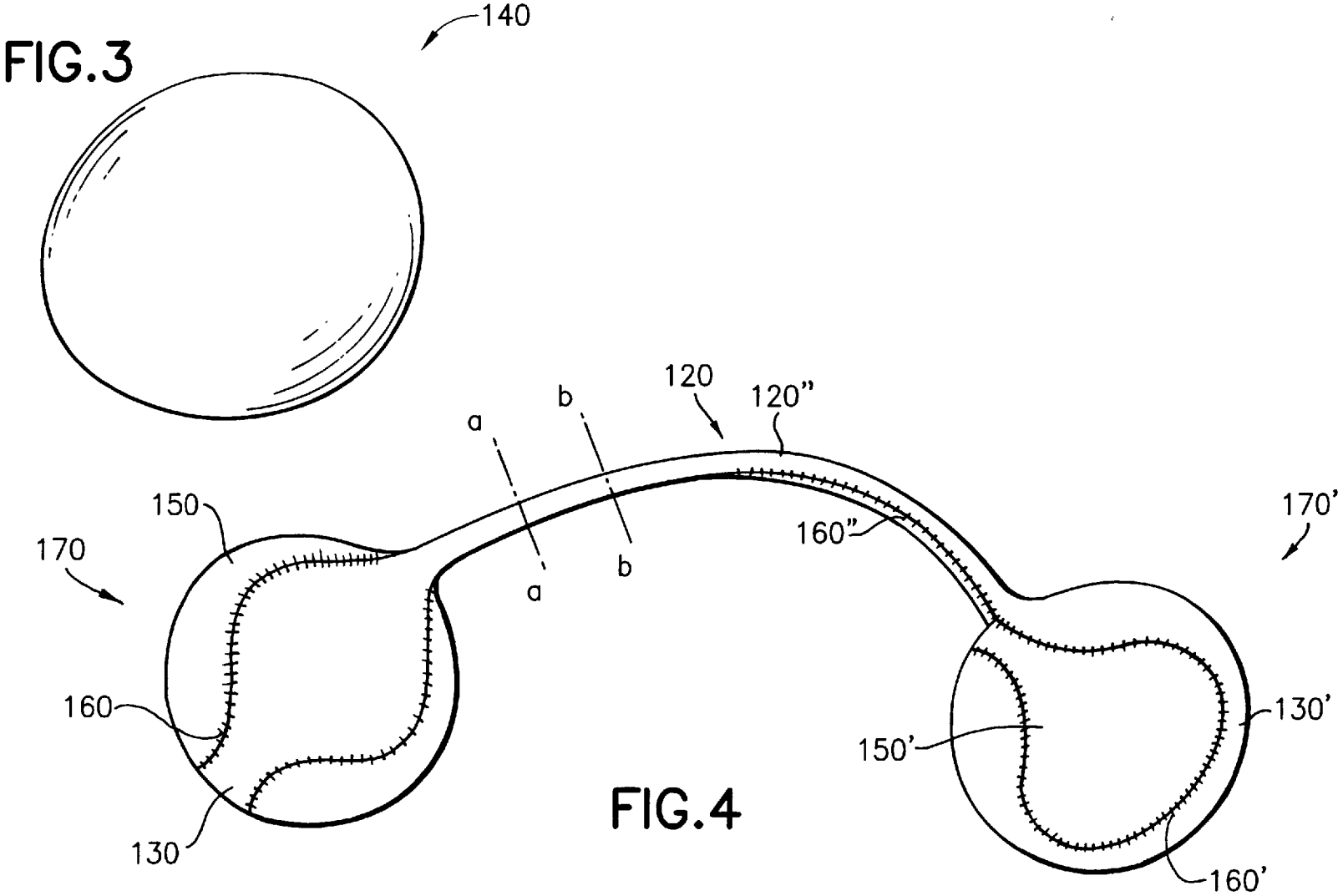
FIG. 3 shows in exaggerated fashion a deformable core for use with this invention.
FIG. 4 shows in exaggerated fashion the individual pieces of the double ball device shown in FIG. 2 assembled in a double ball device according to this invention.

As shown in FIG. 2, a double ball device 100 according to my invention comprises a first piece of material 110, a second piece of material 150, a third piece of material 150', a first deformable core 140, a second deformable core 140', and means for securing the foregoing materials together (not shown in FIG. 2 but shown as 160, 160' in FIG. 4).

First piece of material 110 is a durable material having an essentially linear shape along its middle section 120' and terminating at a first end 130 in a first essentially hourglass shaped section and at a second end 130' in a second essentially hourglass shaped section.

Second piece of material 150 is a durable material having an essentially hourglass shape essentially similar in size to the hourglass shape of said first hourglass shaped section.

Third piece of material 150' is a durable material having an essentially hourglass shape essentially similar in size to the hourglass shape of said second hourglass shaped section.

Preferably, first, second, and third pieces of material 110, 150, and 150' are made from buckskin rawhide. Alternatively, these materials can be made from any leather, neoprene, plastic, rubber or other natural or synthetic material, or combination of materials sufficiently durable to withstand the forces to which the material will be put to during play.

First deformable core 140 is a deformable material that is positioned between said second piece of durable hourglass shaped material 150 and said first hourglass shaped section of said first piece 130.

Second deformable core 140' is a deformable material that is positioned between said third piece of durable hourglass shaped material 150' and said second hourglass shaped section of said first piece 130'.

Preferably, first and second deformable core are made from high density polyurethane (HDP) plastic pellets. Alternatively, sand, rubber particles, rice, or other natural or artificial materials or combinations of material that are sufficiently deformable and durable to provide the desired ball action can be used. While core material comprising pellets or particles are preferred, it will be appreciated that a single piece of material, as shown in FIG. 3, such as a rubber ball sized to the dimension of the desired core can also be used to provide yet a different type of ball action to the double ball device.

As shown in FIG. 4, first means 160 for securing said second piece of durable hourglass shaped material 150 to said first hourglass shaped section 130 of said first piece is a stitching that runs along and extends between the edges of each pair of hourglass shaped pieces that together form each spherical shaped piece. The stitching holds these pieces together around said first deformable core 140 (shown in FIG. 2) so as to form a first spherical shape 170 at said first end of said first piece of durable material 120.

Also as shown in FIG. 4, second means 160' for securing said third piece of durable hourglass shaped material 150' to said second hourglass shaped section of said first piece 130' is a stitching that runs along and extends between the edges of each pair of hourglass shaped pieces that together form each spherical shaped piece. The stitching holds these pieces around said second deformable core 140' so as to form a spherical shape 170 at said second end of said first piece of durable material 120.

Figure 5:
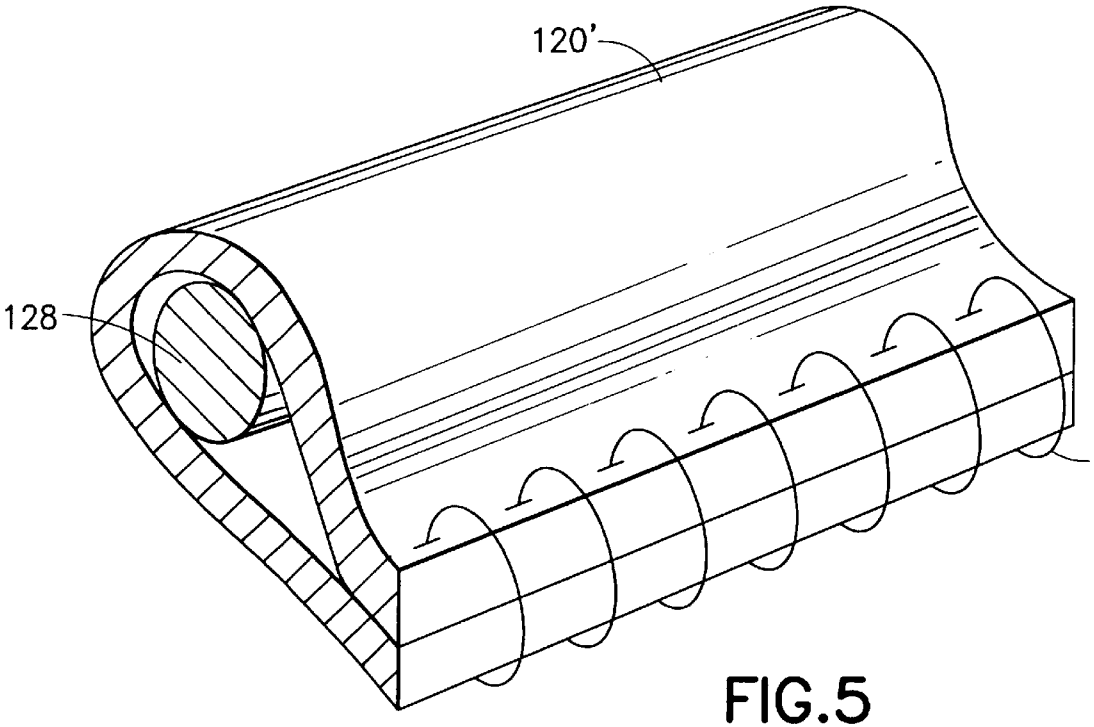
FIG. 5 shows in exaggerated fashion a section of the, double ball device shown in FIG. 4 taken along phantom lines a—a–b—b shown in FIG. 4.

Preferably the middle section 120' of first piece of material 110 is folded lengthwise is shown in FIG. 5, and provided with a third means 160" securing the lengthwise edges of middle section 120' together. Such a fold provides for doubling-up of the material along the length of the middle section and as a result provides greater strength along this section of the first piece of material 110 connecting the double balls of the device together. FIG. 5 shows such a fold taken along the section of the middle section 120' shown in FIG. 4 to lie between phantom lines a—a–b—b. Although not required but as also shown in FIG. 5, such a fold can also be provided along the inside of the fold with a filler material 128 to further strengthen the properties of the middle section 120' of the first piece of material 110. While cotton string has been found to work quite nicely as filler material 128, other filler materials that provide the desired properties to the middle section 120' of the first piece of material 110 can be used.

Preferably, stitching used for first and second securing means 160, 160', and 160" is a string of nylon. Alternatively, woven natural fibers or other strands of natural or synthetic materials having sufficient strength to hold the pieces of material around their associates cores during play can be used.

While in the foregoing description, three separate means for securing parts together—namely 160, 160', 160"—have been described, it will be appreciated that a single means for securing parts together can also be used with good results. In this case, a single piece of nylon sting is used to thread the double ball pieces together in a way not unlike done by the separate securing means 160, 160', and 160". Alternatively, two separate means for securing parts together can be used, with each means starting at opposite ends for example, and coming together at some mid-point along the double ball device.

In the preferred embodiment, first and second deformable cores 140 and 140' are about 2¼ inches in circumference when the deformable cores are formed into a spherical shape. With HDP pellets as the preferred material for use as the deformable core, this gives each ball a nice weight. The weight and dynamics of the balls can be varied with choice and shape of core material used. The hourglass shaped ends 130, 130' of the first piece, and the hourglass shaped second and third pieces of material, 150, 150', respectively, are so sized as to surround the 2¼ inch circumference deformable cores in a snug tight fit. The middle section 120 of the first piece 110 is preferably 8 inches in length although other lengths may be used to provide the desired ball action during play.

Figure 6:
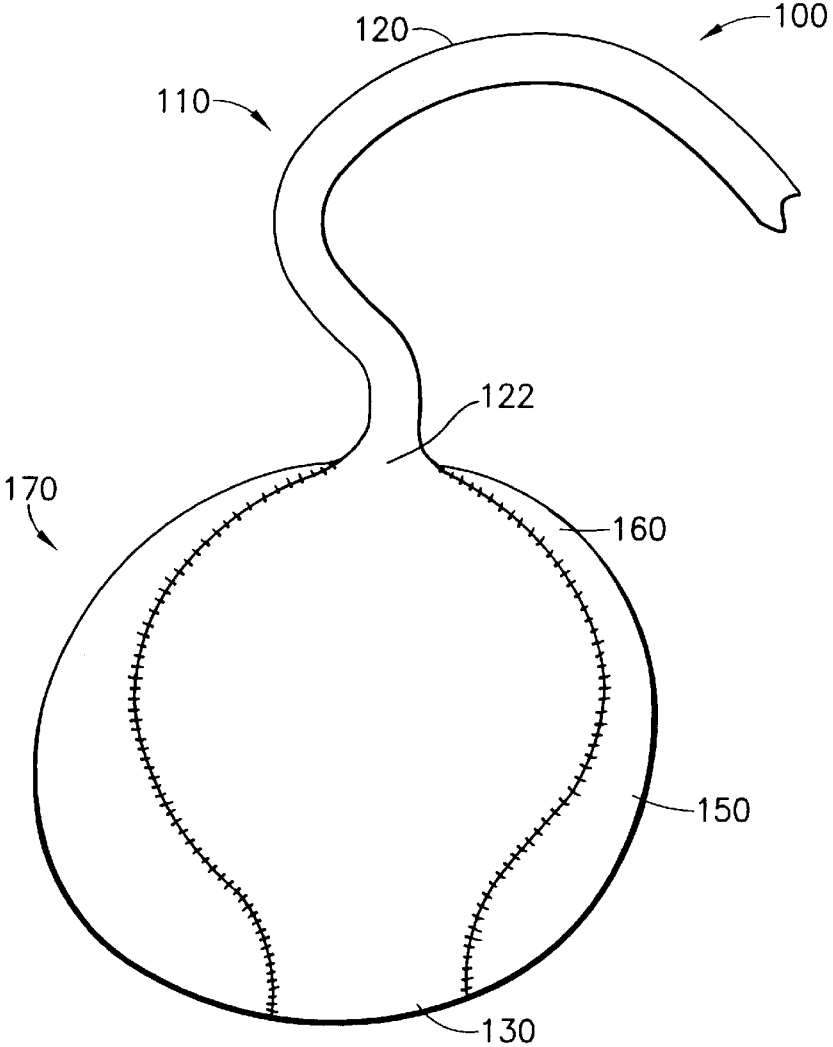
FIG. 6 shows in exaggerated fashion the front side of one of the spherical balls forming the double ball device shown in FIG. 4.

FIG. 6 shows the front side of spherical ball 170 shown in FIG. 4. First piece of material 120 is seen to extend into hourglass terminal end 130 there. Stitching 160 is seen to extend along and between the edges of hourglass end 130 and second piece of hourglass material 150. No stitching 160 extends across neck 122 of double ball device 100 in this Figure.

Figure 7:
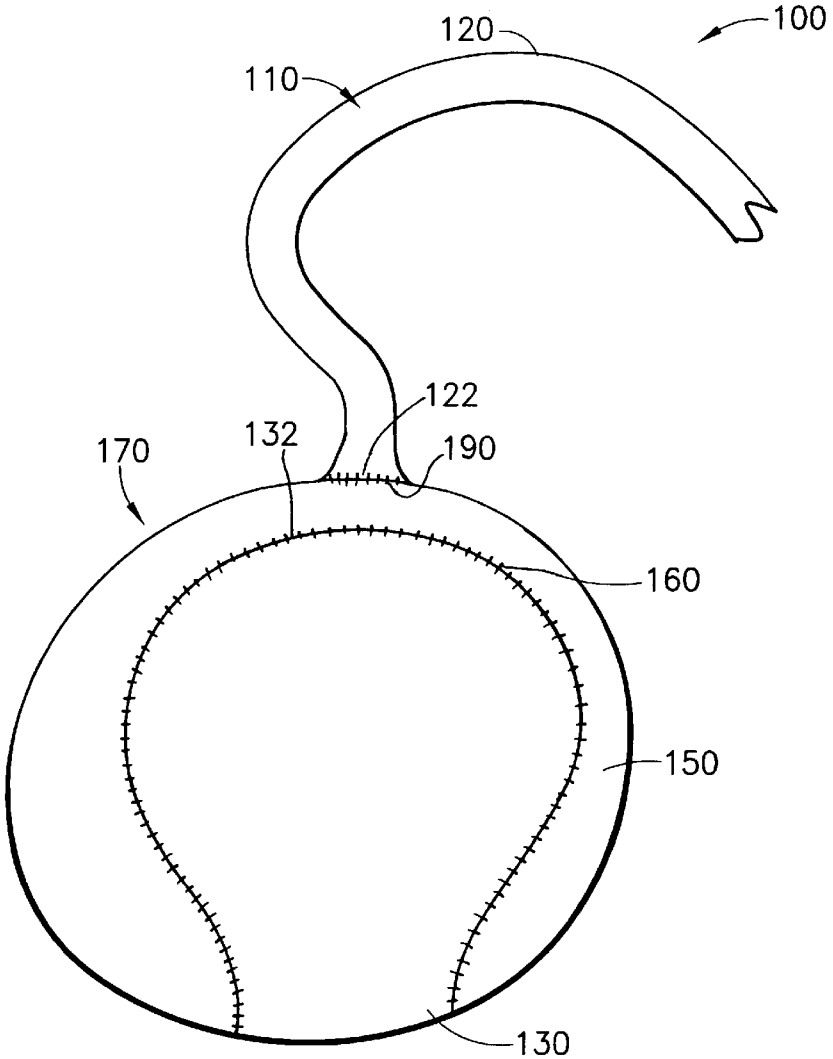
FIG. 7 shows in exaggerated fashion the back side of the spherical ball shown in FIG. 6.

On the back side of spherical ball 170 as shown in FIG. 7, in contrast, a stitching 190, preferably of the same material as stitching 160 is seen to extend across neck 122 of the double ball device. Stitching 190 closes the space that would otherwise exist between the neck 122 of the first piece of material 110 and terminal end 132 of the end piece 130 of said first piece of material 110. While in the preferred embodiment, stitching 190 is used to form a cover about core 140 that completely encloses the core, it will be appreciated that double ball device 100 can work well even without a stitching 190 so provided to completely cover the core. In that case, there would be an opening between terminal end 132 of the end piece 130 of said first piece of material 110 and the neck 122 of said first piece of material 110. Where particles are used for core 140, the filler 128 shown in FIG. 5 and extending along the full length of the middle section 120' of the first piece 110 can be used to keep the particles forming the core from falling out the foregoing opening and to otherwise keep the particles in place inside the double balls of the device.

Figure 8:
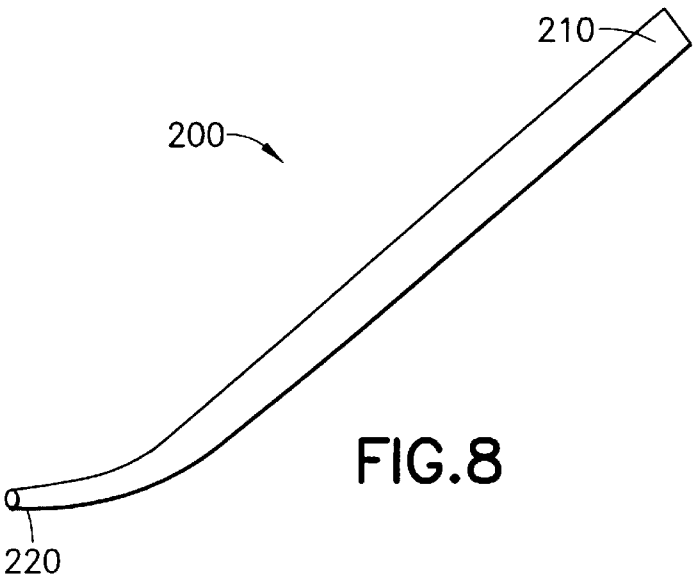
FIG. 8 shows in exaggerated fashion a stick for use with the double ball device of this invention.

FIG. 8 shows a stick used to play Double Ball. Preferably, the stick is about 45 inches in length; although sizes varying from 2 to 6 feet have been found to work nicely for this game. On a first end 210, the stick is shaped to form a handle. On the other leading end 220, the stick is thinner in construction and slightly curved so as to make it easier to pick up the ball by the cord. Preferably, the stick is made from alder. Alternatively, the stick can be made from other wood or from plastic, or other natural or artificial materials or combinations of materials sufficiently strong to withstand the forces imparted upon the stick during play.

In play, the thin leading edge of the stick of FIG. 8 is used to pick up the balls by placing the leading edge under the middle section 120 of the double ball device 110 of FIG. 4. With the stick under the double ball device, a player can advance the device downfield toward the opponent's goal by running downfield, passing to other members of the team, and otherwise moving the ball to the point where it can be thrown over a crossbar positioned between a pair of spaced apart goal posts located on the opponent's end of the field. A point is given each time a team scores in this way and the team with the most points at the end of the game wins.

It will be appreciated that the double ball construction shown in FIG. 4, in which two balls are formed in part by the piece of material used to connect the balls results in a double ball construction that allows both balls to be firmly held together, yet allows a good degree of freedom of the balls with respect to each other when thrown by a player during play. Hourglass shaped ends 130, 130' of middle section 120 advantageously allow spherical balls 170 and 170' shown in FIG. 4 to be so tightly integrated with the hourglass end pieces 150, 150' as to provide for a more durable construction than prior known double ball devices. Hourglass shaped ends 130, 130' and 150, 150', respectively, allow for a mating of these pieces about a deformable core to provide a snug fit.

In addition, the more durable multi-piece construction ball of this invention allows for flexibility in weighting of the balls, because it allows the hourglass pieces forming each ball to nicely and firmly receive a wide range of ball weights. This is accomplished by this invention as a result of the point of connection between ball and the piece connecting the balls actually being provided by the half of the ball that is formed by the connecting piece's hourglass terminal end shapes. This novel means for connecting the balls expands the point of stress of the connection across a good part of the ball and in this way goes far toward minimizing the accumulation of stress points along the piece connecting the balls; which points of stress could otherwise result in a break in the connecting piece requiring a replacement of the double ball and introducing a delay in game.

While the invention has been described in terms of the embodiments indicated above, it will be appreciated that obvious changes and modifications to the embodiments above are deemed to be within the scope of this invention.

I claim:

1. A device for use in playing double ball comprising:

a first piece of durable material having a middle section and a first and a second end section, said middle section having an essentially linear shape and terminating at a first terminal end and a second terminal end, said first and second end section of said first piece of durable material defining a first essentially hourglass shaped section and a second essentially hourglass section, respectively, each hourglass section having a top end, a bottom end and opposing side ends, said first terminal end of said middle section terminating at said top end of said first hourglass shaped section and said second terminal end of said middle section terminating at said top end said second hourglass shaped section;

a second piece of durable material having an essentially hourglass shape essentially similar in size to the hourglass shape of said first hourglass shaped section;

a third piece of durable material having an essentially hourglass shape essentially similar in size to the hourglass shape of said second hourglass shaped section;

a first deformable core positioned between said second piece of durable hourglass shaped material and said first hourglass shaped section of said first piece;

a second deformable core positioned between said third piece of durable hourglass shaped and said second hourglass shaped section of said first piece;

first means for securing said second piece of durable hourglass shaped material to said first hourglass shaped section of said first piece around said first deformable core so as to form a first spherical shape at said first terminal end of said middle section of said first piece of durable material; and second means for securing said third piece of durable hourglass shaped material to said second hourglass shaped section of first piece around said second deformable core so as to form a second spherical shape at said second terminal end of said middle section of said first piece of durable material;

wherein said middle section of said first piece of durable material hold said first and second spherical shapes together so as to allow said first and second spherical shapes to move together when thrown by a player during play.

2. The device of claim 1 wherein said first and second securing means is a stitching that runs along and extends between the edges of each pair of hourglass shaped pieces that form each spherical shaped piece.

3. The device of claim 1 wherein said deformable core is a high density polyurethane.

4. The device of claim 1 wherein said deformable core is sand.

5. The device of claim 1 wherein said deformable core is rice.

6. The device of claim 1 wherein said first, second, and third pieces of material are made from buckskin rawhide.

7. The device of claim 1 wherein said first, second, and third pieces of material are made from neoprene.

8. The device of claim 1 wherein said first, second, and third pieces of material are made from plastic.

9. The device of claim 1 wherein said first, second, and third pieces of material are made from rubber.

10. The device of claim 1 further comprising a third means for securing said bottom end of said first hourglass shaped section to said first terminal end of said middle section of said first piece of material and a fourth means for securing said bottom end of said second hourglass shaped section to said second terminal end of said middle section of said second piece of material when said hourglass shaped ends of said first and second pieces are secured to said second and third hourglass shaped pieces to form said spherical shaped ends.

11. The device of claim 1 wherein said middle section of said first piece of material is folded lengthwise so that lengthwise edges of said middle section overlap and said device of claim 1 further comprising a third means for securing said overlapping edges together in secured engagement.

12. The device of claim 11 further comprising a filler material extending along the inside part of said folded middle section of said first piece of material, said filler material serving to strengthen said middle section of said first piece.

13. The device of claim 1 wherein said first means for securing said second section of hourglass shaped material to said first hourglass shaped section further secures said bottom end of said first hourglass section to said first terminal end of said middle section and said second means for securing said third section of hourglass shaped material to said second hourglass shaped section further secures said bottom end of said second hourglass section to said second terminal end of said middle section.

14. The degree of claim 1, further comprising a third means for securing said bottom end of said first hourglass to said first terminal end of said middle section and a fourth means for securing said bottom end of said second hourglass section to said second terminal end of said middle section.

15. The device of claim 14 wherein said third and fourth securing means is a stitching that runs along and extends between the edges of said bottom ends of said first and second hourglass shaped sections and said first and second terminal ends of said middle section, respectively.

* * * * *